US006477769B2

(12) United States Patent
Lamatsch et al.

(10) Patent No.: US 6,477,769 B2
(45) Date of Patent: Nov. 12, 2002

(54) METHOD FOR ASSEMBLING A CONTROLLED IMPEDANCE CONNECTOR

(75) Inventors: Michael J. Lamatsch, Roseville, MN (US); Gerard A. Drewek, Rosemount, MN (US); JoAnn M. Peterson, Apple Valley, MN (US)

(73) Assignee: General Dynamics Information Systems, Inc., Bloomington, MN (US)

( * ) Notice: Subject to any disclaimer, the term of this patent is extended or adjusted under 35 U.S.C. 154(b) by 11 days.

(21) Appl. No.: 09/780,659

(22) Filed: Feb. 9, 2001

(65) Prior Publication Data

US 2001/0023148 A1 Sep. 20, 2001

Related U.S. Application Data

(60) Provisional application No. 60/181,719, filed on Feb. 11, 2000.

(51) Int. Cl.[7] ..... H01R 43/04

(52) U.S. Cl. ..... 29/861; 825/828; 825/829; 81/9.51

(58) Field of Search ..... 29/825, 828, 829, 29/830, 837, 863, 861; 81/9.51

(56) References Cited

U.S. PATENT DOCUMENTS

| | | | | |
|---|---|---|---|---|
| 3,484,936 A | * | 12/1969 | Schwalm et al. | |
| 3,621,560 A | * | 11/1971 | Le Bright | |
| 4,053,200 A | * | 10/1977 | Pugner | 29/828 |
| 4,059,330 A | * | 11/1977 | Shirey | 29/828 |
| 4,268,957 A | * | 5/1981 | Sbuelz | |
| 4,295,270 A | * | 10/1981 | Cammarata | |
| 4,719,697 A | * | 1/1988 | Schwartzman et al. | 29/828 |
| 5,207,596 A | | 5/1993 | Tran | 439/585 |
| 5,402,566 A | * | 4/1995 | Long | |
| 5,480,325 A | | 1/1996 | Tran et al. | 439/578 |
| 5,961,348 A | | 10/1999 | Murphy | 439/579 |
| 5,994,646 A | | 11/1999 | Broeksteeg et al. | 174/74 |

* cited by examiner

*Primary Examiner*—Carl J. Arbes
(74) *Attorney, Agent, or Firm*—Jenner & Block, LLC

(57) ABSTRACT

A method for assembling an impedance controlled connector using conventional connector shells and inserts and corresponding connector pins and sockets. Controlled impedance cables are prepared and physically arranged for termination in a conventional connector shell in a configuration which enhances the impedance control characteristic of the assembled connector. Assembly of the connector is effected using conventional materials and tools.

20 Claims, 6 Drawing Sheets

METHOD FOR ASSEMBLING A CONTROLLED IMPEDANCE CONNECTOR

CROSS REFERENCE TO RELATED APPLICATIONS

This application claims priority from U.S. Provisional Patent Application Serial No. 60/181,719, filed on Feb. 11, 2000.

BACKGROUND OF THE INVENTION

1. Field of the Invention

The invention relates generally to electrical connectors and, more particularly, to a method for assembling a controlled impedance electrical connector using conventional components.

2. The Prior Art

Electrical signals operating at very high frequencies require controlled impedance and energy containment in their associated wiring and connectors. Commonly, controlled impedance and energy containment is effected by using shielded or coaxial cable and/or special electrical connectors or connector inserts. Such connectors typically are custom-made for particular applications and, therefore, often are expensive and not readily available when needed.

It would be beneficial to provide a method for fabricating a controlled impedance connector for a variety of applications using readily available, conventional components.

SUMMARY OF THE INVENTION

The present invention provides a novel method for assembling a controlled impedance electrical connector, such as the connector disclosed in co-pending U.S. patent application Ser. No. 09/607,487. More particularly, the present invention provides a method for assembling a controlled impedance electrical connector using conventional connector components, including conventional connector shells and inserts. The method of the present invention can be used in connection with connector shells having nearly any cross-section, including, without limitation, circular, square, and rectangular. The method of the present invention can be used to assemble an impedance controlled connector for use with conductors carrying a variety of signals, including single-ended signals, differential signals, and bidirectional differential signals. Test results indicate that a controlled impedance electrical connector assembled using the process of the present invention provides appropriate energy containment for signals varying in frequency from direct current (DC) to approximately 3.5 GHz.

In a preferred embodiment, the method of the present invention can be used to terminate an impedance controlled cable, such as a cable having a center conductor and a surrounding shielding braid, to a conventional insert in a conventional electrical connector shell. Preferably, the impedance controlled cable is prepared for termination by first stripping a length of outer jacket away from an end of the impedance controlled cable, leaving all but a short length of the underlying shielding braid in place. The exposed shielding braid then can be pushed back against the end of the remaining outer jacket, exposing the inner dielectric insulation. A short length of the inner dielectric insulation (and center conductor protective wrap, if present) is removed to expose the center conductor. Preferably, the center conductor is folded back upon itself to provide an adequate diameter for crimping.

In a preferred embodiment, a standard M39029/56-348 connector socket or M39029/58-360 connector pin (or the respective, suitable alternative) then is crimped onto the center conductor using a conventional crimping tool and die. A small section of shrinkable tubing can be installed across the gap between the crimp contact, i.e., the connector socket or connector pin, and the inner dielectric insulation to provide additional mechanical strength to the connection.

The shielding braid then is replaced over the inner dielectric insulation. Preferably, the shielding braid is spread evenly over the inner dielectric insulation, ensuring that no opening in the braid has a dimension larger than 1/20 of a wavelength corresponding to the highest frequency to be handled by the connector (or, in a time domain, 1/20 of the fastest transition speed of a signal, as would be known to one skilled in the art). A wire can be wrapped around the braid to cover any opening of excessive size. If such a cover wire is used, it preferably is soldered to the shielding braid to improve the overall shielding characteristic and to hold the wire in place, thus ensuring the opening remains covered. A drain wire preferably is added around the shielding braid near the end of the outer cable jacket and soldered in place.

The foregoing steps describe the preferred method for preparing a cable carrying a single-ended signal for termination at a connector insert. The method of the present invention also can be used in connection with, for example, multiple cables or a multi-wire cable carrying differential signals and bidirectional differential signals, among others. In a differential signal application, a second cable or wire is prepared and terminated in the same manner as for the single-ended signal application described above. The drain wires of the two cables or wires then are twisted and preferably soldered together. A standard M39029/56-348 connector socket or M39029/58-360 connector pin (or the respective, suitable alternative) is crimped onto the twisted and soldered drain wires using conventional tools. In a bidirectional differential signal application, a second pair of cables or wires for the second signal path also is prepared, as described above.

The prepared cables and/or wires are arranged into a predetermined pattern in which they will be configured when installed into the connector. This pattern is selected to ensure that the assembled connector will exhibit adequate impedance control characteristics. This pattern can be determined using any suitable parameter extraction software, such as the Maxwell® program available from the Ansoft Corporation of Pittsburgh, Pa., or other commercial or proprietary program. One suitable alternative software package is available from Innoveda of Redmond, W.Va.

The prepared and arranged wires are inserted into a conventional insert in a conventional connector housing in the predetermined pattern. Preferably, all of the conductor termination components (i.e., connector sockets or pins) associated with a particular cable or group of cables are pressed into the connector insert substantially simultaneously, a little bit at a time, to avoid placing excessive strain on any of the wiring. Any practical number of conductors can be prepared for and terminated at a connector in the foregoing manner. Once installed into a connector, individual connector sockets and/or pins can be removed and reinserted using conventional insertion and removal tools.

If reference planes are needed for impedance control within the connector, as would be known to those skilled in the art, they may be provided by inserting signal pins into the connector insert in a predetermined configuration and grounding them to the connector shell, thus forming a Faraday Cage around the signal wires requiring such impedance control measures. Preferably, the grounds (or drains) of the relevant signal wires are connected to any of these grounded pins.

Overall shielding of the cable also can be accomplished using conventional connector fittings in a novel manner. More particularly, the shielding can be bunched at the location where the shielding normally ends. This allows the shield to continue within the connector to provide impedance control right up to the inner face of the connector housing.

DETAILED DESCRIPTION OF THE PREFERRED EMBODIMENT

Figure 1A:
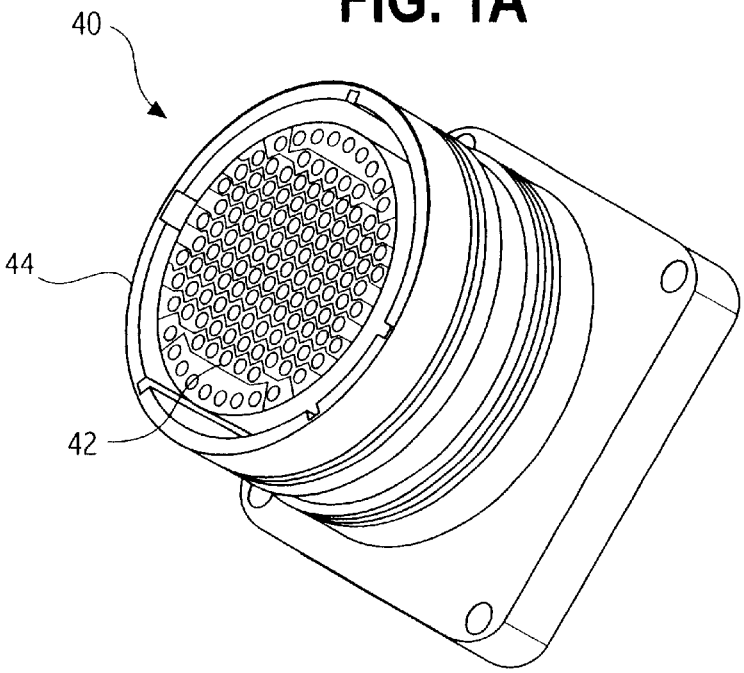
FIG. 1A is a perspective view of a conventional connector for use in accordance with the present invention.
Figure 1B:
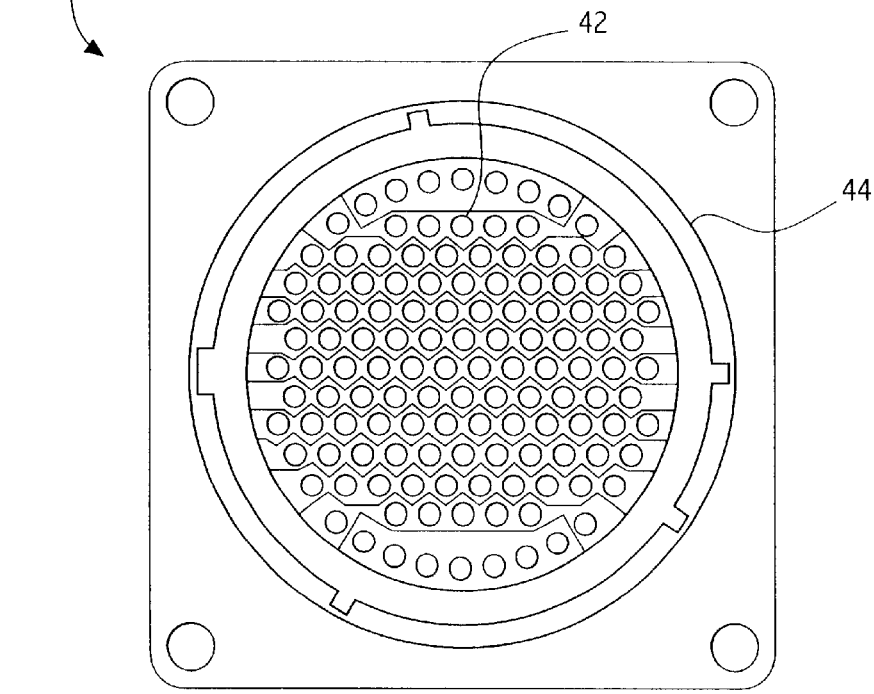
FIG. 1B is an end elevation view of a conventional connector for use in accordance with the present invention.
Figure 2:
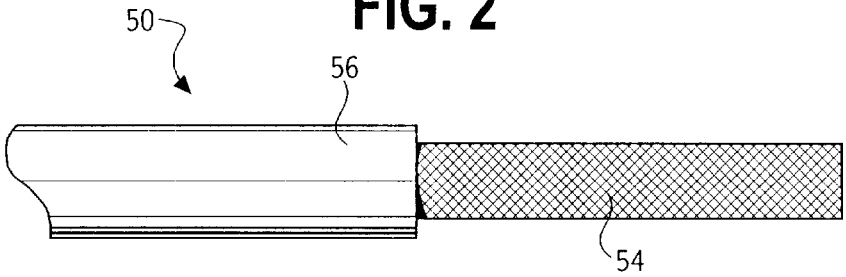
FIG. 2 is a side elevation view of an insulated conductor partially prepared for termination to a connector in accordance with the method of the present invention.
Figure 3:
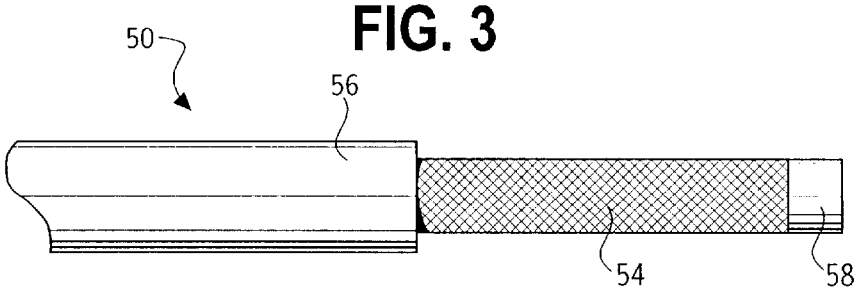
FIG. 3 is a side elevation view of an insulated conductor partially prepared for termination to a connector in accordance with the method of the present invention.
Figure 4:
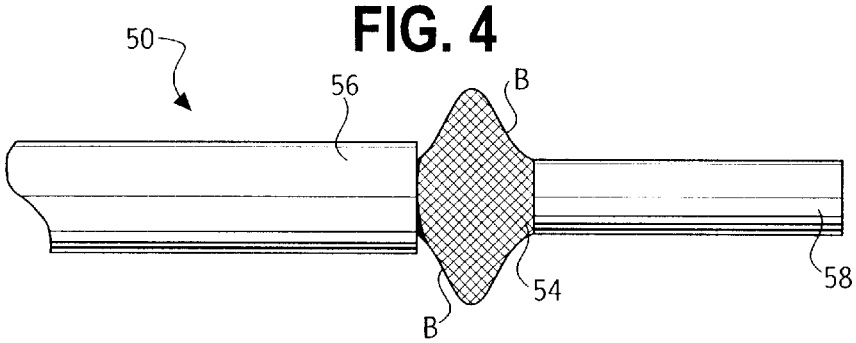
FIG. 4 is a side elevation view of an insulated conductor partially prepared for termination to a connector in accordance with the method of the present invention.
Figure 5:
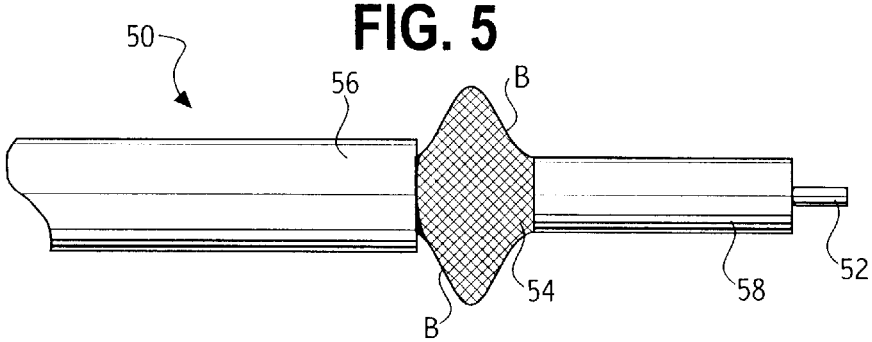
FIG. 5 is a side elevation view of an insulated conductor partially prepared for termination to a connector in accordance with the method of the present invention.
Figure 6:
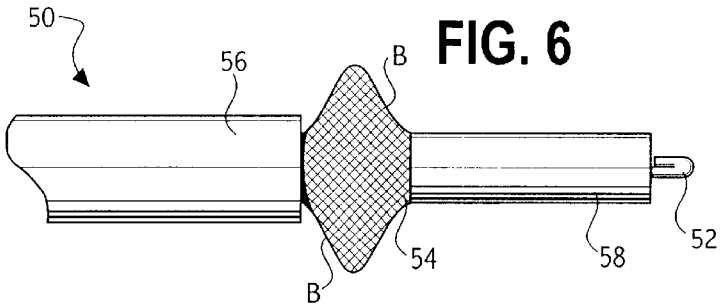
FIG. 6 is a side elevation view of an insulated conductor partially prepared for termination to a connector in accordance with the method of the present invention.
Figure 7:
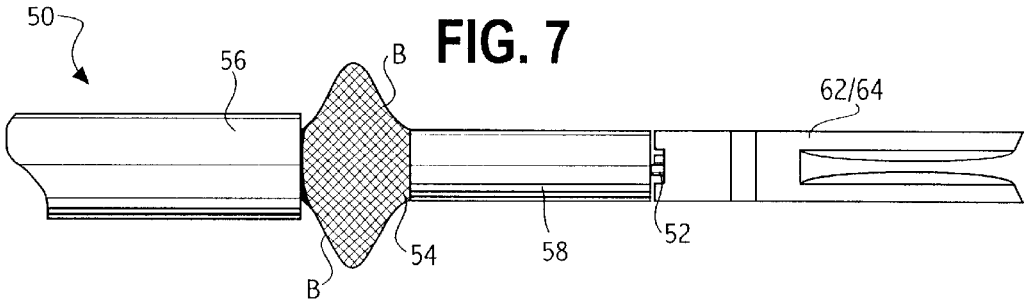
FIG. 7 is a side elevation view of an insulated conductor partially prepared for termination to a connector in accordance with the method of the present invention.
Figure 8:
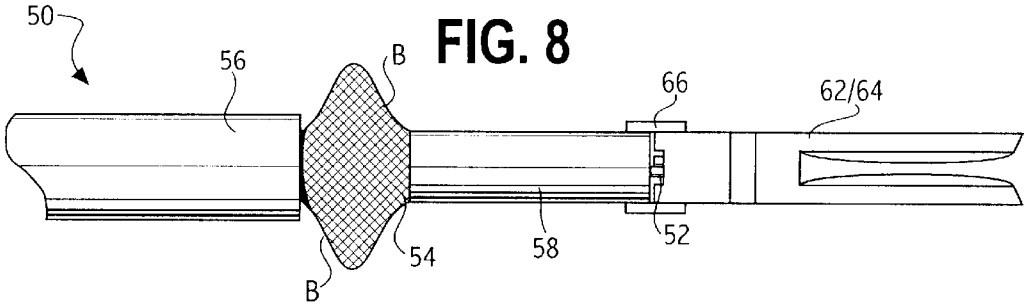
FIG. 8 is a side elevation view of an insulated conductor partially prepared for termination to a connector in accordance with the method of the present invention.

The present invention provides a method for assembling a controlled impedance electrical connector 40 using conventional components, including, for example, a conventional connector shell 44 and a conventional connector insert 42, as illustrated in FIG. 1A and FIG. 1B. In a preferred embodiment, the method of the present invention can be used in connection with an impedance controlled cable, such as cable 50 having center conductor 52, surrounding inner dielectric insulation 58, and surrounding shielding braid 54, as illustrated in, for example, FIG. 5. In this embodiment, impedance controlled cable 50 is prepared for termination at connector 40 by first stripping a length (preferably about one inch) of outer jacket 56 away from a free end of impedance controlled cable 50, leaving underlying shielding braid 54 in place, as illustrated in FIG. 2. A short length (preferably about ⅛ inch) of shielding braid 54 then is removed, as illustrated in FIG. 3. The exposed portion of shielding braid 54 then is pushed back towards the end of previously cut-back outer jacket 56, i.e., away from the free end of cable 50, thus exposing inner dielectric insulation 58 covering center conductor 52. Typically, when shielding braid 54 is pushed back in this manner, a bulge B is formed therein, as illustrated in FIGS. 4–8. A short length (preferably about ⅛ inch) of inner dielectric insulation 58 and the center conductor protective wrap, if present (not shown), is removed to expose center conductor 52, as illustrated in FIG. 5. The portion of center conductor 52 thus exposed can be then folded back upon itself, as illustrated in FIG. 6, if necessary to provide an adequate diameter for crimping, as described below.

In a preferred embodiment, a conductor termination component, such as a connector socket 62 or a connector pin 64, then is crimped onto center conductor 52 using a conventional crimping tool and die (not shown). Connector socket 62 can be a standard connector socket, such as an M39029/56-348 connector socket or a suitable alternative. Similarly, connector pin 64 can be a standard connector pin, such as an M39029/58-360 connector pin or a suitable alternative. The resulting gap 68 between inner dielectric insulation 58 and connector socket 62 or connector pin 64 (and, therefore, the exposed length of center conductor 52) should be kept to a minimum. Preferably, a short section of shrinkable tubing 66 is installed across gap 68 to provide additional mechanical strength to the connection. See FIGS. 7 and 8.

Figure 9:
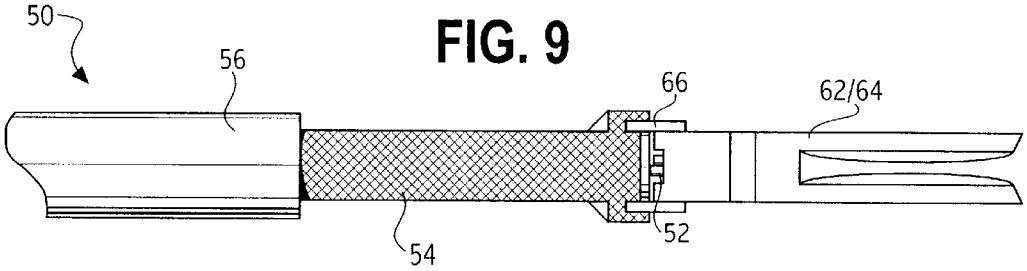
FIG. 9 is a side elevation view of an insulated conductor partially prepared for termination to a connector in accordance with the method of the present invention.
Figure 10:
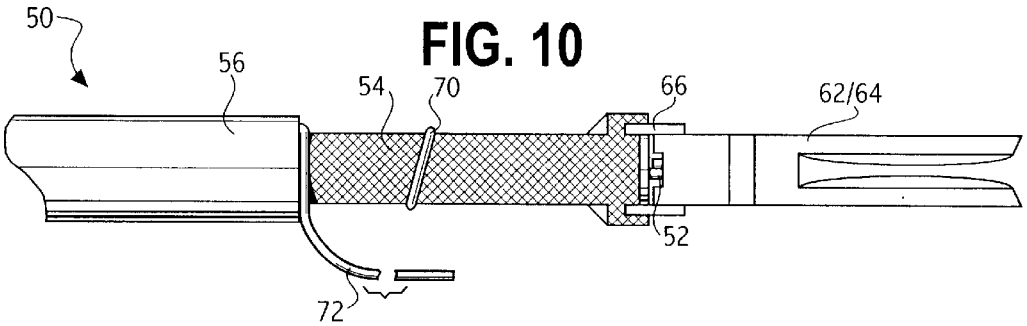
FIG. 10 is a side elevation view of an insulated conductor partially prepared for termination to a connector in accordance with the method of the present invention.

Shielding braid 54 then is replaced over inner dielectric insulation 58. Shielding braid 54 preferably is spread evenly over inner dielectric insulation 58, ensuring that no opening in shielding braid 54 has a dimension larger than 1/20 of a wavelength of the highest frequency to be handled by the connector (or, in a time domain, 1/20 of the fastest transition speed of a signal, as would be known to one skilled in the art). See FIG. 9. A cover wire 70 can be wrapped around shielding braid 54 to cover any opening of excessive size. If such a wire 70 is used, it preferably is soldered to shielding braid 54 to improve the energy containment characteristic and, therefore, the impedance control of the overall cable and connector structure. A drain wire 72 preferably is installed around shielding braid 54 near the end of outer cable jacket 56 and soldered in place to the shielding braid. See FIG. 10. The free end of drain wire 72 preferably is terminated to a conductor termination component, such as a connector socket 62 or a connector pin 64.

Figure 11:
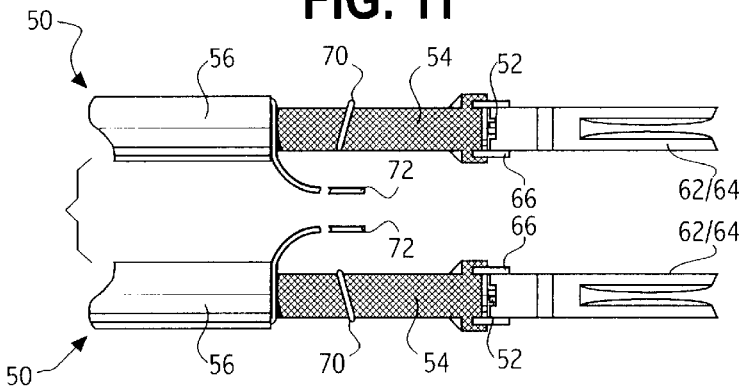
FIG. 11 is a side elevation view of a pair of insulated conductors partially prepared for termination to a connector in accordance with the method of the present invention.
Figure 12:
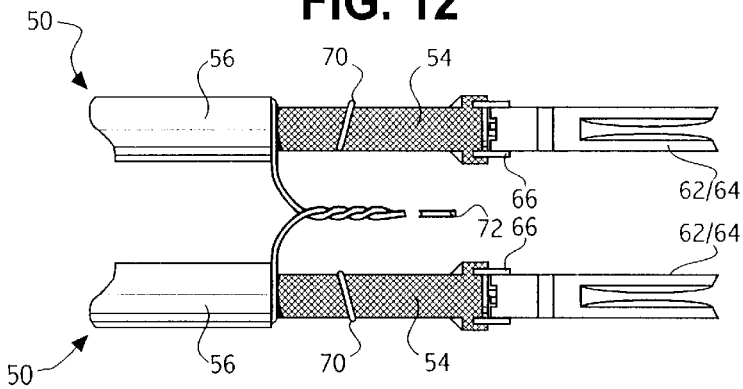
FIG. 12 is a side elevation view of a pair of insulated conductors partially prepared for termination to a connector in accordance with the method of the present invention.
Figure 13:
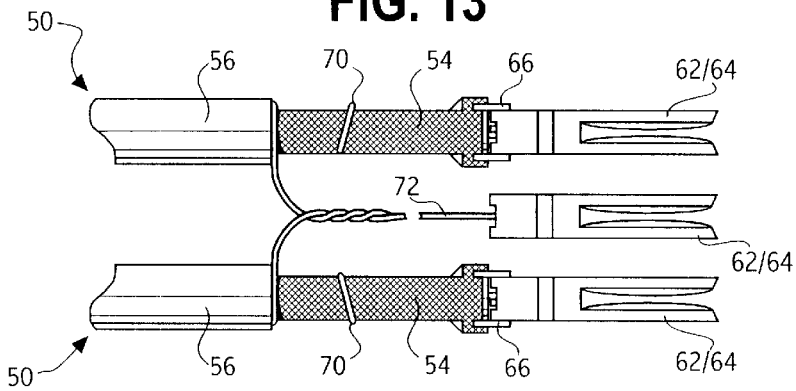
FIG. 13 is a side elevation view of a pair of insulated conductors partially prepared for termination to a connector in accordance with the method of the present invention.
Figure 14:
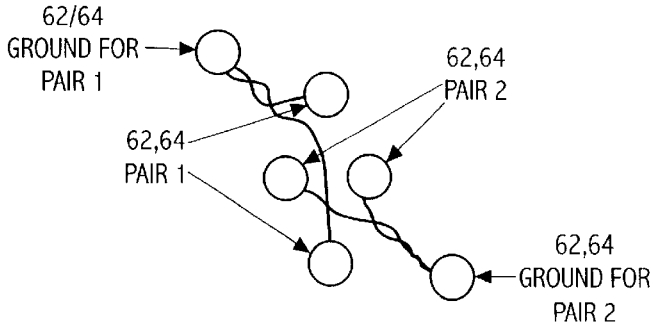
FIG. 14 is an end elevation view of a plurality of conductors prepared for insertion into a connector in accordance with the method of the present invention.

The foregoing steps describe the preparation of a typical impedance controlled cable 50 carrying a single-ended signal for termination to a connector 40. An impedance controlled cable (or group of cables) carrying more than one signal path and, therefore, having more than one conductor, can be prepared in a similar manner. For example, a differential signal can be transmitted using a pair of impedance controlled cables 50. In such a differential signal application, each of the cables 50 is prepared as described above, and the drain wires 72 of the two cables 50 preferably are twisted and soldered together. See FIGS. 11 and 12. A connector socket 62 or connector pin 64, as described above, preferably is crimped onto the twisted and soldered drain wires 72, as illustrated in FIG. 13. When twisting and soldering the drain wires 72, consideration should be given to the pattern and spacing of the prepared cables 50 and connectors sockets 62 and/or pins 64 into the connector insert 42, as will be further discussed below. The foregoing technique also may be used in an application involving a bidirectional differential signal and, therefore, two pairs of impedance controlled cables 50, by preparing a second pair of cables 50, as described above, for the second signal path. See FIG. 14. The method of the present invention can be used in other applications, as well.

The prepared cables 50 and connector sockets 62 and/or pins 64 are arranged into a predetermined pattern in which they will be routed when installed into the connector, as would be known to one skilled in the art. See FIG. 14. The predetermined pattern is selected to ensure that the completely assembled connector will exhibit adequate energy containment and impedance control characteristics. This pattern can be determined using suitable parameter extraction software, such as the Maxwell® program available from Ansoft Corporation of Pittsburgh, Pa. or other similar commercial or proprietary program.

Figure 15:
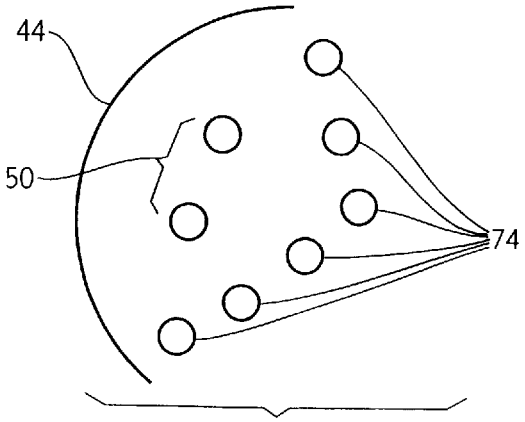
FIG. 15 is a partial end elevation view of a connector shell and insert for use in connection with the method of the present invention.

The prepared connector sockets 62 and/or pins 64 are inserted into a conventional connector insert 42 in a conventional connector housing 44 in the predetermined pattern. In multiple-signal/multi-wire applications, such as the two conductor plus drain differential configuration or the four conductor plus two drains bidirectional differential conductor configuration, all connector sockets 62 and/or pins 64 are pressed into connector insert 42 substantially simultaneously, a little bit at a time, to avoid placing excessive strain on any of the wiring. See FIG. 15. Any practical number of cables 50 can be prepared for and terminated at a connector 40 in the foregoing manner. Once installed into a connector, individual connector sockets 62 and pins 64 can be removed and reinserted using conventional insertion and removal tools.

Figure 16:
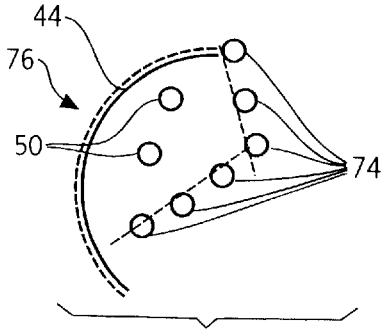
FIG. 16 is another partial end elevation view of a connector shell for use in connection with the method of the present invention.
Figure 17:
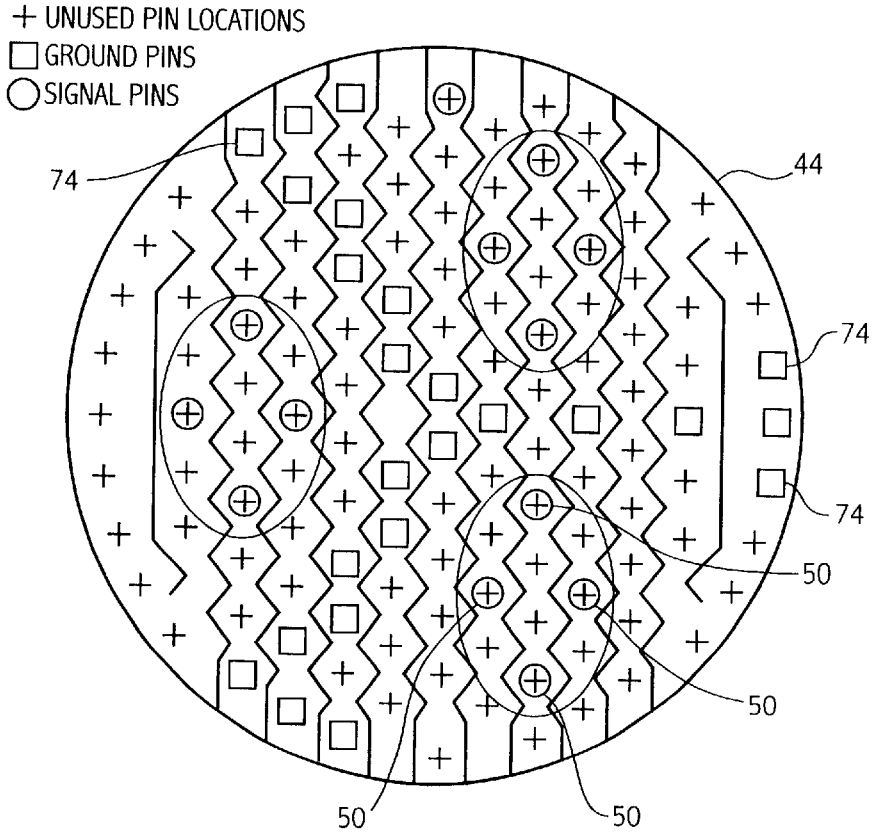
FIG. 17 is an end elevation view of a controlled impedance connector prepared in accordance with the method of the present invention using a conventional connector shell and insert.

If reference planes are required for impedance control within a connector 40, they may be provided by inserting grounding pins 74 in the connector insert 42 in a predetermined configuration and grounding them to the connector shell 44, thus forming a Farady cage 76 around the signal paths requiring such impedance control measures, as would be known to one skilled in the art. See FIGS. 16 and 17. Preferably, the grounds (drains wires 72) of the applicable cables 50 are connected to any of the corresponding grounding pins 74.

Figure 18:
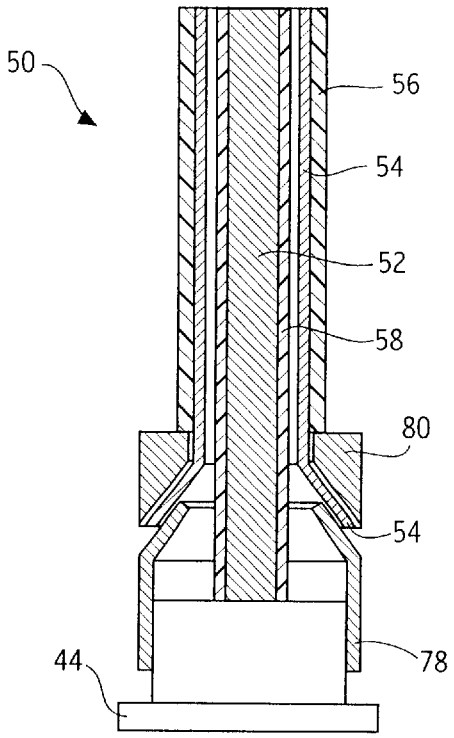
FIG. 18 is a side elevation view of a conventional shield termination.
Figure 19:
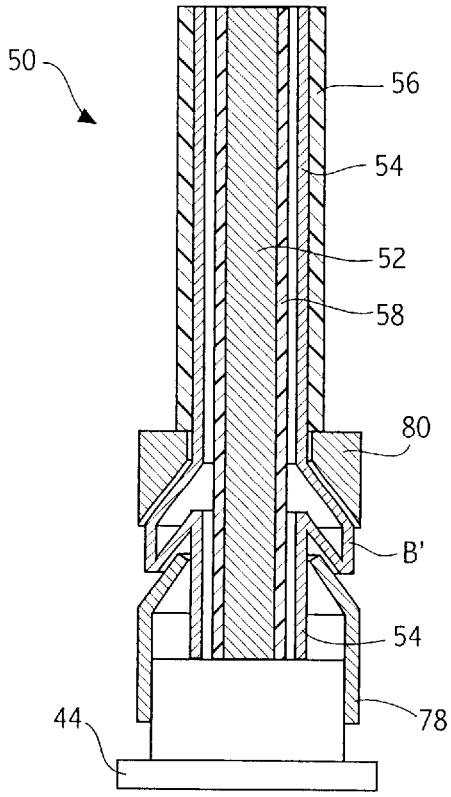
FIG. 19 is a side elevation view of an impedance controlled shield termination according to the present invention.

Overall shielding of an impedance controlled cable 50 also can be accomplished using conventional connector fittings in a novel manner. In a conventional cable-to-connector termination, as illustrated in FIG. 18, a length of shielding braid 54 is cut back from the free end of cable 50 and terminated between a shield collar 78 and a retainer ring 80 adjacent to connector shell 44. A novel impedance controlled termination can be realized by preparing the end of cable 50 to be terminated so that the length of shielding braid 54 is sufficient to extend to, and preferably into, the end of connector shell 44 and to form a bulge B' of shielding braid 54 in the region between shield collar 78 and retaining ring 80 prior to securing retaining ring 80 in place.

The foregoing techniques have been described and shown for use with connectors having circular cross sections. However, these techniques also may be used with connectors having other cross sections, including, without limitation, square or rectangular.

Whereas the present invention has been described with respect to specific embodiments thereof, it is understood that various changes and modifications will be suggested to one skilled in the art and it is intended that the invention encompass such changes and modifications as fall within the scope of the appended claims.

What is claimed is:

1. A method for assembling an impedance controlled electrical connector using a conventional connector shell and connector insert, for use in connection with an impedance controlled cable having a conductor, dielectric insulation covering said conductor, a shielding braid, and an outer jacket, comprising the steps of:

removing a portion of said outer jacket proximate a free end of said cable;

retracting a portion of said shielding braid in a direction away from said free end of said cable;

removing a portion of said dielectric insulation proximate said free end of said cable, thus exposing said conductor;

crimping a first electrical termination component onto said exposed conductor;

extending said retracted shielding braid toward said free end of said cable;

connecting a drain wire to said shielding braid;

crimping a second electrical termination component onto said drain wire; and inserting said first and second electrical termination components into said connector insert in a predetermined pattern.

2. The method of claim 1 further comprising the step of removing a portion of said shielding braid proximate said free end of said cable.

3. The method of claim 2 wherein said length of removed outer jacket is greater than said length of removed shielding braid.

4. The method of claim 1 wherein said predetermined pattern is selected to control impedance of a signal passing through said connector.

5. The method of claim 1 further comprising the step of inserting at least one ground pin into said connector insert in a predetermined configuration.

6. The method of claim 5 further comprising the step of electrically connecting said at least one ground pin to said connector shell.

7. The method of claim 6 further comprising the step of electrically connecting said shielding braid to said ground pin.

8. The method of claim 1 wherein said cable further comprises a conductor protective wrap, further comprising the step of removing a length of said conductor protective wrap.

9. The method of claim 1 further comprising the step of folding a portion of said exposed conductor back upon itself.

10. The method of claim 1 wherein said electrical termination component is a connector pin.

11. The method of claim 1 wherein said electrical termination component is a connector socket.

12. The method of claim 1 further comprising the step of placing a section of shrinkable tubing over the gap formed between said insulation and said connector termination component when said component is crimped onto said conductor.

13. The method of claim 1 further comprising the step of placing a cover wire over an opening in said shielding braid having a dimension greater than a predetermined dimension.

14. The method of claim 13 further comprising the step of soldering said cover wire to said braid.

15. The method of claim 1 wherein said drain wire is soldered to said shielding braid.

16. A method for assembling an impedance controlled electrical connector using a conventional connector shell and connector insert, for use in connection with a plurality of impedance controlled cables, each of said cables having a conductor, dielectric insulation covering said conductor, a shielding braid, and an outer jacket, comprising the steps of:

removing a portion of said outer jacket of each of said cables proximate a free end of said cables;

retracting a portion of said shielding braid of each of said cables away from said free end of said cables;

removing a portion of said dielectric insulation proximate said free end of said cables, thus exposing said conductor of each of said cables;

crimping an electrical termination component onto each of said exposed conductors;

extending said retracted shielding braid toward said free end of each of said cables;

connecting a drain wire to the shielding braid of each of said cables;

joining said drain wires together;

crimping an electrical termination component onto said joined drain wires;

inserting said electrical termination components into said connector insert in a predetermined pattern.

17. A method for assembling an impedance controlled electrical connector using a conventional connector shell and connector insert having a shield collar and a retaining ring, for use in connection with an impedance controlled cable having a conductor, dielectric insulation covering said conductor, a shielding braid, and an outer jacket, comprising the steps of:

removing a portion of said outer jacket from said cable;

terminating said conductor in said insert;

extending said shielding braid into the body of said connector shell;

forming a bulge in said shielding braid;

capturing said bulge in said shielding braid between said shielding collar and said retaining ring.

18. A method for assembling an impedance controlled connector using a conventional connector shell and connector insert having a shield collar and a retaining ring, for use in connection with an impedance controlled cable having a conductor, dielectric insulation covering said conductor, a shielding braid, and an outer jacket, comprising the steps of:

removing a portion of said outer jacket from said cable;

terminating said conductor in said insert;

forming a bulge in said shielding braid at a predetermined distance from the free end thereof;

extending said free end of said shielding braid to the end of the body of said connector shell; and capturing said bulge in said shielding braid between said shield collar and said retaining ring.

19. The method recited in claim 18 wherein said step of extending said free end of said shielding braid toward the body of said connector shell further comprises locating said free end of said shielding braid between said conductor and said shield collar.

20. The method recited in claim 18 further comprising the step of extending said free end of said shielding braid into the body of said connector shell.

* * * * *